US011306539B2

(12) United States Patent
Liu et al.

(10) Patent No.: US 11,306,539 B2
(45) Date of Patent: Apr. 19, 2022

(54) EXECUTING MECHANISM FOR ROTARY GUIDE DEVICE AND ROTARY GUIDE DEVICE

(71) Applicant: INSTITUTE OF GEOLOGY AND GEOPHYSICS, CHINESE ACADEMY OF SCIENCES, Beijing (CN)

(72) Inventors: Qingbo Liu, Beijing (CN); Qingyun Di, Beijing (CN); Yongyou Yang, Beijing (CN); Xiangyang Wang, Beijing (CN); Qijun Xie, Beijing (CN)

(73) Assignee: INSTITUTE OF GEOLOGY AND GEOPHYSICS CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/262,113

(22) PCT Filed: Jul. 1, 2020

(86) PCT No.: PCT/CN2020/099626
§ 371 (c)(1),
(2) Date: Jan. 21, 2021

(87) PCT Pub. No.: WO2021/174732
PCT Pub. Date: Sep. 10, 2021

(65) Prior Publication Data

US 2021/0355757 A1 Nov. 18, 2021

(30) Foreign Application Priority Data

Mar. 5, 2020 (CN) ..... 202010148737.3

(51) Int. Cl.
*E21B 4/06* (2006.01)
*E21B 7/06* (2006.01)
*E21B 34/06* (2006.01)

(52) U.S. Cl.
CPC ..... *E21B 7/061* (2013.01); *E21B 34/066* (2013.01); *E21B 7/064* (2013.01)

(58) Field of Classification Search
CPC . E21B 7/06; E21B 7/061; E21B 7/064; E21B 34/066
See application file for complete search history.

(56) References Cited

U.S. PATENT DOCUMENTS 8,087,479 B2 * 1/2012 Kulkarni ..... E21B 10/62 175/73
8,256,538 B1 9/2012 Deslierres et al.
(Continued)

FOREIGN PATENT DOCUMENTS

CN 102704840 A 10/2012
CN 109025820 A 12/2018
(Continued)

OTHER PUBLICATIONS

Search Report dated Aug. 24, 2020 in corresponding Chinese Patent Application No. 202010148737.3 (5 pages).
(Continued)

*Primary Examiner* — Taras P Bemko

(57) ABSTRACT

An executing mechanism for a rotary guide device includes a driving valve core, a driven valve core, a first cavity, a second cavity and a high-pressure slurry driving channel. The first cavity includes a first low-pressure port communicating with a low-pressure slurry; and a first high-pressure port communicating with a high-pressure slurry. The driving valve core adjusts a pressure in the first cavity; and the driven valve core moves in response to a pressure difference between the first cavity and the second cavity. The high-
(Continued)

pressure slurry driving channel switches between an open state and a close state in response to movement of the driven valve core. A rotary guide device includes a rotary main shaft, a drill bit, a push mechanism, and the executing mechanism. The push mechanism includes a push block and a push plunger piston, the high-pressure slurry driving channel communicates with one end, distal from the push block, of the push plunger piston.

20 Claims, 6 Drawing Sheets

(56) References Cited

U.S. PATENT DOCUMENTS

| | | | | |
|---|---|---|---|---|
| 9,631,432 | B2 * | 4/2017 | Downton | E21B 7/04 |
| 2016/0298418 | A1 * | 10/2016 | James | E21B 34/066 |
| 2018/0252088 | A1 * | 9/2018 | Tilley | E21B 21/10 |
| 2021/0062585 | A1 * | 3/2021 | Nanayakkara | E21B 7/06 |
| 2021/0164292 | A1 * | 6/2021 | Deolalikar | E21B 7/06 |
| 2021/0285290 | A1 * | 9/2021 | D'Silva | E21B 7/06 |

FOREIGN PATENT DOCUMENTS

| | | | |
|---|---|---|---|
| CN | 109025821 | A | 12/2018 |
| CN | 110130830 | A | 8/2019 |

OTHER PUBLICATIONS

Written Opinion (Form PCT/ISA/237); dated Nov. 30, 2020 in corresponding International Patent Application No. PCT/CN2020/099626; (10 pages) (6 pages English Translation).

* cited by examiner

EXECUTING MECHANISM FOR ROTARY GUIDE DEVICE AND ROTARY GUIDE DEVICE

CROSS REFERENCE TO RELATED APPLICATIONS

This application is a U.S. National Stage Application under 35 U.S.C. § 371 of PCT International Patent Application No. PCT/CN2020/099626, filed on Jul. 1, 2020, which claims the foreign priority benefit under 35 U.S.C. § 119 of Chinese Patent Application No. 202010148737.3, filed on Mar. 5, 2020, in the China National Intellectual Property Administration, the contents of both of which International Patent Application and the Chinese Application are incorporated by reference herein in their entirety.

TECHNICAL FIELD

The present application relates to the technical field of drilling equipment, and in particular, to an executing mechanism for a rotary guide device.

BACKGROUND

Rotary guide belongs to one of the most cutting-edge technologies in the field of drilling and has been widely applied. Rotary guide is a technology that may adjust well deviation and azimuth continuously, automatically and in real time in the drilling process according to the requirement of the well trajectory to realize high-precision trajectory control. The rotary guide system makes the drill bit or the drill collar to generate axial offset by controlling the offset mechanism to complete guide action, wherein the offset mechanism is divided into a pushing type and a directional type; the pushing type is represented by PowerDriveX6 of Schlumberger and AutoTrack of Baker Hughes; and the principle of realizing the guide action by the pushing type offset mechanism is to push the drill collar by the pushing device to provide a lateral force to the drill bit. Since part of properties of the pushing type rotary guide system is more excellent than those of the directional type rotary guide system, the pushing type rotary guide system has been widely applied.

In the prior art, the pushing type rotary guide system mainly relies on the pushing piston on the drilling tool to change the drilling direction of the drill, and the executing mechanism in the rotary guide device is a mechanism that provides a pushing force to the pushing piston when the drilling tool requires guide during underground work. In the patent document CN110130830A, a pushing type rotary guide device based on pressure difference of drilling fluid is disclosed. The executing mechanism in the device drives the valve core to perform a reciprocating motion through a reciprocating motion of the driving mechanism so as to control the pressure of the drilling fluid to drive the pushing piston. In actual use, it is necessary to increase the slurry flow to increase the response speed of the pushing piston, and it is necessary to use a larger valve core to obtain large slurry flux, which will increase the power consumption of a system and is unfavorable for the underground working environment; therefore, in the rotary guide device using the pressure difference of the drilling fluid for pushing in the prior art, it is difficult for the executing mechanism to achieve the best of both worlds between the response speed of the pushing piston and the power consumption of a system.

SUMMARY

To solve the above technical problems, the present application provides an executing mechanism for a rotary guide device. The executing mechanism for the rotary guide device includes a driving valve core, a driven valve core, a first cavity, a second cavity and a high-pressure slurry driving channel, wherein the first cavity includes a first low-pressure port communicating with low-pressure slurry; the first cavity further includes a first high-pressure port communicating with high-pressure slurry; the driving valve core moves to open and close the first low-pressure port and the first high-pressure port to adjust a pressure in the first cavity; two sides of the driven valve core are respectively adjacent to the first cavity and the second cavity; the driven valve core moves in response to a pressure difference between the first cavity and the second cavity; the driven valve core is connected to the high-pressure slurry driving channel; and the high-pressure slurry driving channel switches between an open state and a close state in response to movement of the driven valve core.

The driving valve core moves to open and close the first low-pressure port and the high-pressure port, which is interpreted as follows: the driving valve core can move between a first position and a second position; the first low-pressure ports opens and the first high-pressure port closes when the driving valve is at the first position, and the first low-pressure port closes and the second high-pressure port opens when the driving valve core is at the second position; or the first low-pressure port closes and the second high- pressure port opens when the driving valve core is at the first position, and the first low-pressure ports opens and the first high-pressure port closes when the driving valve is at the second position.

If the executing mechanism of the present application is not provided with the driven valve core and only provided with the driving valve core, pressure output may be conducted, but to ensure that the driving valve core has larger pressure output force, that is, faster response, a circulation port for the high-pressure slurry to circulate is large enough, the driving valve core with a larger volume is required, movement of the driving valve core needs to be provided by the power piece such as a motor and the like, and high power consumption of the system is unfavorable for safe operation in the underground environment. The executing mechanism of the present application is provided with the driven valve core so as to effectively reduce the power consumption of the system on the basis of further increasing the response speed. Specifically, the present application is provided with the driven valve core, which may change a pressure in the first cavity, thereby forming pressure difference between the first cavity and the second cavity and providing a driving force to the driven valve core. Only a small driving force is required to complete the process, so the power consumption of the system can be effectively reduced as long as the driving valve has a small volume. The driven valve performs pressure output moves under the action of pressure difference between the first cavity and the second cavity so as to perform pressure output, and it is unnecessary to provide additional power in this process; therefore, the driven valve may be provided with a structure with a large volume, may increase the flow of slurry and may provide a large push force, that is, the push response speed of the executing mechanism is increased. Furthermore, in the present application, the process of pressure output is completed through linked cooperation of the driving valve core and the driven valve core. Compared with a single structure, namely the transmission process only using the driving valve, the process is more stable and may change flexibly according to the actual application scenario, that is, changing the structure of the driven valve core may change the size, the output response speed and the like of the output force.

Further, the second cavity includes a second low-pressure port communicating with low-pressure slurry; the second cavity further includes a second high-pressure port communicating with high-pressure slurry; the driving valve core moves between a first position and a second position, the first low-pressure port opens and the first high-pressure port closes when the driving valve core is at the first position, and the first low-pressure port closes and the first high-pressure port opens when the driving valve core is at the second position; the driven valve core moves between a third position and a fourth position, the second low-pressure port opens and the second high-pressure port closes when the driven valve core is at the third position, and the second low-pressure port closes and the second high-pressure opens when the driven valve core is at the fourth position; when the driving valve core moves from the first position to the second position, the driven valve core moves in response to the driving valve core; and when the driven valve core moves from the third position to the fourth position, the high-pressure slurry driving channel communicates with the second cavity.

According to the present application, a pressure in the first cavity is adjusted and a pressure difference is formed between the first cavity and the second cavity through the movement of the driving valve core, so that the driven valve core is driven to move; and the movement of the driven valve core is configured to control the high-pressure slurry driving channel to open and close, so that the executing mechanism optionally outputs or does not output pressure. Through cooperation of the driving valve core and the driven valve core, the executing mechanism can effectively reduce the power consumption of the system while adjusting the response speed of pressure output.

The executing mechanism further includes a first limiting portion and a second limiting portion, wherein the driven valve core moves between the first limiting portion and the second limiting portion, the first limiting portion is arranged between the first cavity and the driven valve core, and the second limiting portion is arranged between the second cavity and the driven valve core. The present application is provided with the first limiting portion and the second limiting portion, which may play a role in limiting the movement of the driven valve core, thereby limiting the movement trajectory of the driven valve core and improving the working efficiency and the working precision of the driven valve core.

The executing mechanism further includes an outer shell, wherein the driving valve core and the driven valve core are arranged in the outer shell along an axial direction, the driving valve core is connected to the driven valve core through the first cavity, a side wall of the outer shell is respectively provided with a first low-pressure port and a first high-pressure port at a position of the driving valve core, and the side wall of the outer shell is respectively provided with a second low-pressure port and a second high-pressure port at a position of the driven valve core. In the present application, the outer shell plays a role in integrating the driving valve core and the driven valve core into a whole, so that on one hand, mounting of the driving valve and the driven valve is facilitated, and on the other hand, detachable mounting and maintenance of the executing mechanism are facilitated.

Further, a first clamping groove and a second clamping groove are formed in an inner wall of the outer shell; the first clamping groove is formed in one side, proximal to the first cavity, of the driven valve core; the second clamping groove is formed in one side, proximal to the second cavity, of the driven valve core; and the driven valve core moves between the first clamping groove and the second clamping groove. On one hand, the purpose of setting two clamping grooves in the present application is to limit the driven valve core in two directions when the driven valve core does reciprocating motion, that is, the driven valve core only can move between the first clamping groove and the second clamping groove along an axial direction to limit the movement of the driven valve core; and on the other hand, due to the existence of the clamping grooves, a diameter of the driven valve core is increased in a radial direction and a volume of the driven valve core is increased, which is beneficial to increase the circulation quantity of slurry passing through the driven valve core, thus increasing a pressure output force.

Further, the driving valve core includes a driving piece and a valve core shaft, wherein one end of the valve core shaft is connected to the driving piece and the other end of the valve core shaft is adjacent to the first cavity, a first connecting hole and a second connecting hole are respectively formed at one end, proximal to the first cavity, of the valve core shaft, the first cavity communicates with the first low-pressure port through the first connecting hole, and the first cavity communicates with the first high-pressure port through the second connecting hole; and the driving piece is an electromagnetic valve, and the valve core shaft is connected to the electromagnetic valve through a spring.

In the present application, the driving piece in the driving valve core is configured to drive the valve core shaft to do reciprocating motion, thus realizing a change of a pressure in the first cavity.

The purpose of setting the first connecting hole and the second connecting hole in the present application is, on one hand, to reduce the weight of the valve core shaft as much as possible to further reduce power consumption, and on the other hand, to circulate slurry fluid with different effects in different connecting holes to better guide the slurry fluid without affecting each other. Specifically, it may ensure that high-pressure slurry flowing into the first high-pressure port still flows towards one direction, thus effectively preventing the accumulation of the slurry from affecting the efficiency of a pushing force.

In the present application, the spring is arranged in the electromagnetic valve, so that the valve core shaft may automatically reset after losing an attractive force of the electromagnetic valve, thus further reducing the power consumption of the system.

The executing mechanism further includes a sealing piece and a balancing plunger piston, wherein the sealing piece is arranged at one end, distal from the valve core shaft, of the driving piece, and a first oil immersing space is formed between the sealing piece and the driving piece; and the balancing plunger piston is arranged at one end, distal from the sealing piece, of the driving piece, the balancing plunger piston is arranged at the periphery of the valve core shaft in a radial direction, and a second oil immersing space is formed between the driving piece and the balancing plunger piston.

The purpose of the sealing piece and the balancing plunger piston in the present application is to protect the electromagnetic valve and prevent slurry from entering; another purpose of the balancing plunger piston in the present application is to realize pressure balance of slurry in and outside the executing mechanism to self-adapt to a change of external temperature and pressure, that is, the balancing plunger piston may move in an axial direction according to internal and external pressure difference for adjusting internal and external pressure balance. A plurality of oil immersing spaces are filled with hydraulic oil to achieve the aims of lubricating, dissipating heat and setting pressure balance.

Further, a blind hole is formed at one end, distal from the first cavity, of the driven valve core, and an opening configured to communicate with the second high-pressure port is formed in a side wall, at the position of the blind hole, of the driven valve core. The purpose of setting the blind hole in the present application is, on one hand, to reduce a weight of the driven valve core, that is, reduce the power consumption of the driving valve core as much as possible, so that the driving valve core drives the movement of the driven valve core more easily; and on the other hand, to further increase the circulation quantity of slurry during pressure input to increase response speed.

Further, filtering nets are arranged at communication positions of the first low-pressure port, the first high-pressure port, the second low-pressure port and the second high-pressure port as well as external slurry. The filtering nets are configured to filter the slurry of the executing mechanism to prevent a blockage phenomenon.

The present application further discloses a rotary guide device, including a rotary main shaft, a drill bit, a push mechanism and the executing mechanism according to any one of the above, wherein a slurry channel is formed at the center of the rotary main shaft along the axial direction; the drill bit is connected to one end of the rotary main shaft; the push mechanism is arranged at one end, proximal to the drill bit, of the rotary main shaft, the push mechanism includes a push block and a push plunger piston, the push plunger piston fits in a groove or opening of the push block, and the push block is arranged at the periphery of the push plunger piston; and the executing mechanism is arranged on the rotary main shaft, and the high-pressure slurry driving channel in the executing mechanism communicates with one end, distal from the push block, of the push plunger piston.

In the rotary guide device of the present application, the rotary main shaft is configured to transmit a drilling pressure and a torque; the drill bit is configured to break a rock; the push block in the push mechanism is configured to generate an action force between a drilling tool and a well wall, and the push plunger piston generates a high-pressure thrust to the push block; and the executing mechanism drives the high-pressure slurry driving channel to open to transmit a pressure to the push plunger piston so as to transmit to the push block, that is, the executing mechanism provides a push force to the push mechanism.

The rotary guide device further includes a flow adjusting piece, wherein the flow adjusting piece is arranged at one end, proximal to the drill bit, in the slurry channel, and a throttling hole is axially formed at the center of the flow adjusting piece. The flow adjusting piece in the present application adjusts a flow of slurry near the drill bit so as to adjust a pressure difference inside and outside the drilling tool and adjust an output force of the push mechanism.

Further, the rotary main shaft is provided with three push mechanisms circumferentially and uniformly. Each push mechanism is provided with the executing mechanism in a matched way. A groove structure for placing the executing mechanism is arranged on the rotary main shaft. A connecting hole for communicating with the slurry channel is formed at the bottom end of the groove structure respectively.

Beneficial effects of the present application are as follows:

1. the executing mechanism of the present application is provided with the driven valve core, which may effectively reduce the power consumption of the system on the basis of further increasing the response speed.

2. In the present application, the process of pressure output is completed through linked cooperation of the driving valve core and the driven valve core. Compared with a single structure, namely the transmission process only using the driving valve, the process is more stable and may change flexibly according to the actual application scenario, that is, changing the structure of the driven valve core may change the size of the output force.

3. The purpose of setting the blind hole in the present application is, on one hand, to reduce a weight of the driven valve core, that is, reduce the power consumption of the driving valve core as much as possible, so that the driving valve core drives the movement of the driven valve core more easily; and on the other hand, to further increase the circulation quantity of slurry during pressure input to increase the response speed.

4. The present application is provided with the first limiting portion and the second limiting portion, which may play a role in limiting the movement of the driven valve core, thereby limiting the movement trajectory of the driven valve core and improving the working efficiency of the driven valve core.

5. In the present application, the outer shell plays a role in integrating the driving valve core and the driven valve core into a whole, so that on one hand, mounting of the driving valve and the driven valve is facilitated, and on the other hand, detachable mounting and maintenance of the executing mechanism are facilitated.

6. Due to the existence of the clamping grooves in the present application, the volume of the driven valve core may be increased to a certain degree and the circulation quantity of the slurry passing through the driven valve core is increased, thereby increasing the pressure output force.

7. The purpose of setting the first connecting hole and the second connecting hole in the present application is, on one hand, to reduce the weight of the valve core shaft as much as possible to further reduce power consumption, and on the other hand, to separate a pressure input channel and a pressure output channel and circulate fluid with different effects in different connecting holes to better guide the slurry fluid without affecting each other.

8. The purpose of the sealing piece and the balancing plunger piston in the present application is to protect the electromagnetic valve and prevent slurry from entering; another purpose of the balancing plunger piston in the present application is to realize pressure balance of slurry in and outside the executing mechanism to self-adapt to a change of external temperature and pressure.

9. The flow adjusting piece in the present application adjusts the flow of the slurry near the drill bit so as to adjust the pressure difference inside and outside the drilling tool and adjust an output force of the push mechanism.

BRIEF DESCRIPTION OF FIGURES

The figures described herein are used to provide a further understanding of the present application and form a part of the present application. The schematic examples and descriptions of the present application are used to explain the present application and do not constitute an undue limitation on the present application. In the figures.

DETAILED DESCRIPTION

Figure 1:
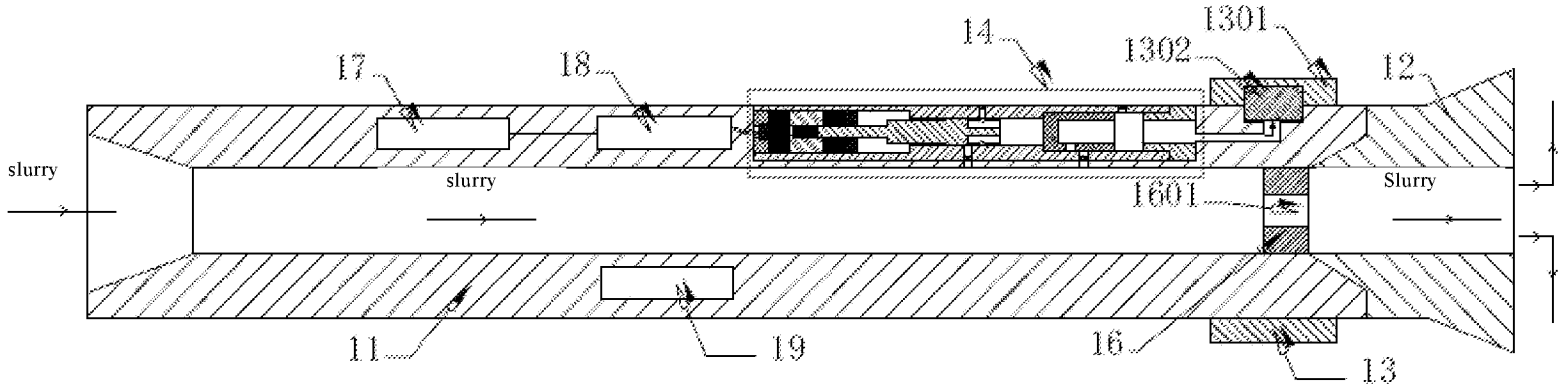
FIG. 1 is a structural schematic diagram of a rotary guide device according to the present application.

To explain the overall conception of the present application more clearly, detailed description is conducted below with reference to the accompanying figures of the specification in the form of examples.

In the following description, many specific details are set forth in order to facilitate full understanding of the present application, but the present application can also be implemented in other ways other than those described herein. Therefore, the protection scope of the present application is not limited by the specific examples disclosed below.

In addition, in the description of the present application, it should be understood that an azimuth or position relationship indicated by terms "center", "upper", "lower", "front", "rear", "left", "right", "vertical", "horizontal", "top", "bottom", "inner", "outer", "axial", "radial", "circumferential" and the like is an azimuth or position relationship based on the accompanying draws, which is only for facilitating description of the present application and simplifying description, but not indicates or implies that the referred device or component must have a specific azimuth and perform construction and operation in the specific azimuth; therefore, it cannot be interpreted as a limitation to the present application.

Besides, the terms 'first', 'second' are used only for description and shall not be interpreted as an indication or implication of relative importance or an implicit indication of the number of technical features. Thus, features defined with "first" and "second" may explicitly or implicitly include one or more of the features. In the description of the present application, "a plurality of" means two or more, unless otherwise specifically defined.

In the present application, unless otherwise specified and limited, the terms "mounting", "connected", "connection", "fixation" and the like should be understood in a broad sense, for example, it may be fixed connection, and may also be detachable connection, or integrated; it may be mechanical connection, may be electric connection and may also be communication; and it may be direction connection, may be indirect connection through an intermediate medium, and may be internal communication of two components or interaction relationship between two components. A person of ordinary skill in the art may understand specific meanings of the above-mentioned terms in the present application based on the specific situation.

In the present application, unless otherwise specified and limited, the first feature "on" or "below" the second feature may be direct contact of the first feature and the second feature, or indirect contact of the first feature and the second feature through the intermediate medium. In the description of the specification, the description of the terms "one example", "some examples", "example", "specific example" or "some examples", etc. means that a specific feature, structure, material or characteristic described in combination with the example or example are included in at least one example or example of the present application. In the present specification, the schematic representation of the above terms does not necessarily mean the same example or example. Furthermore, the particular features, structures, materials, or characteristics described may be combined in a suitable manner in any one or more examples or examples.

EXAMPLE 1

Figure 2:
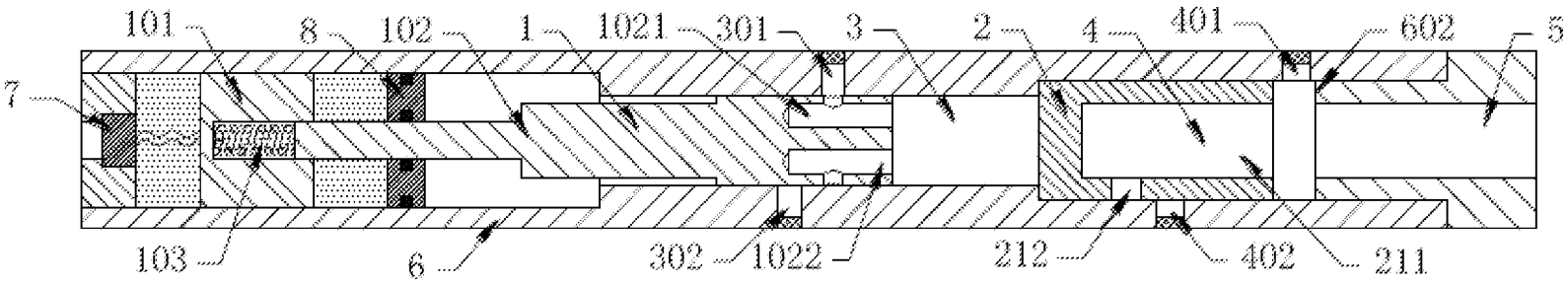
FIG. 2 is a structural schematic diagram of an executing mechanism in an initial state according to the present application.
Figure 3:
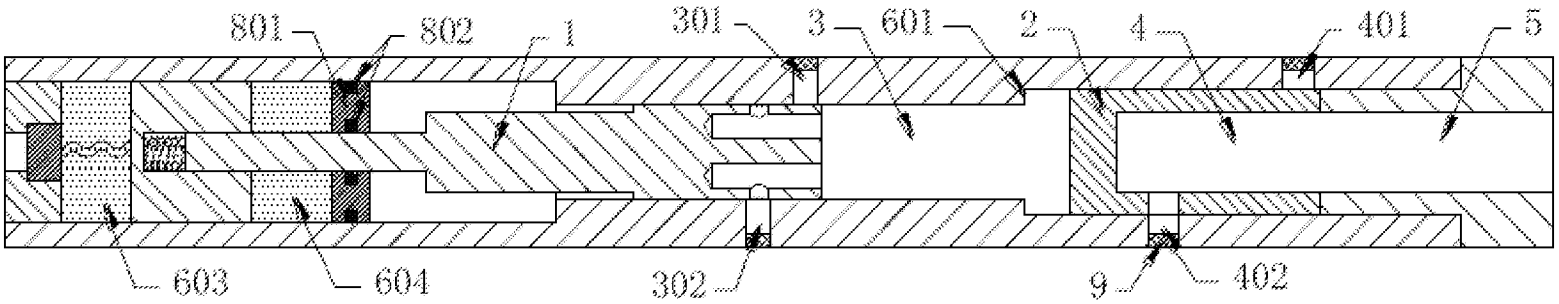
FIG. 3 is a schematic structural diagram of the executing mechanism in FIG. 2 in a working state.

In the example, an executing mechanism for a rotary guide device, as shown in FIG. 2 and FIG. 3, includes a driving valve core 1, a driven valve core 2, a first cavity 3, a second cavity 4 and a high-pressure slurry driving channel 5, wherein the driving valve core 1 is connected to the driven valve core 2 through the first cavity 3; two sides of the driven valve core 2 are respectively adjacent to the first cavity 3 and the second cavity 4; the first cavity 3 includes a first low-pressure port 301 communicating with low-pressure slurry, and the first cavity 3 further includes a first high-pressure port 302 communicating with high-pressure slurry; the second cavity 4 includes a second low-pressure port 401 communicating with the low-pressure slurry, and the second cavity 4 further includes a second high-pressure port 402 communicating with the high-pressure slurry; the driving valve core 1 can move between a first position and a second position; when the driving valve core 1 is at the first position, as shown in FIG. 2, the first low-pressure port 301 opens and the first high-pressure port 302 closes; when the driving valve core 1 is at the second position, as shown in FIG. 3, the first low-pressure port 301 closes and the first high-pressure port 302 opens; the driven valve core 2 can move between a third position and a fourth position; when the driven valve core 2 is at the third position, as shown in FIG. 2, the second low-pressure port 401 opens and the second high-pressure port 402 closes; when the driven valve core 2 is at the fourth position, as shown in FIG. 3, the second low-pressure port 401 closes and the second high-pressure port 402 opens; when the driven valve core 2 moves from the first position to the second position, the driven valve core 2 moves in response to the driving valve core 1, that is, the driven valve core 2 moves from the third position to the fourth position; and the high-pressure slurry driving channel 5 communicates with the second cavity 4.

During use, when the executing mechanism in the example is in an initial state, as shown in FIG. 2, the driving valve core 1 is at the first position and the driven valve core 2 is at the third position, the low-pressure slurry flows from the first low-pressure port 301 to the first cavity 3 and the low-pressure slurry flows from the second low-pressure port 401 to the second cavity 4 at this time, and the pressure of the first cavity 3 is as same as that of the second cavity 4, so the driven valve core 2 is in a stable state; when it is necessary to perform pressure output by the executing mechanism, as shown in FIG. 3, the driving valve core 1 moves from the first position to the second position, the high-pressure slurry flows from the first high-pressure port 302 to the first cavity 3, and the pressure in the first cavity 3 is higher than the pressure in the second cavity 4, so the driven valve core 2 moves from the third position to the fourth position, the high-pressure slurry flows from the second high-pressure port 402 to the second cavity 4 to flows into the high-pressure slurry driving cavity 5 to output the pressure to the outside; and when it is necessary to release the pressure after pressure output, the driving valve core 1 returns to the first position from the second position, the high-pressure slurry in the first cavity 3 flows out of the first low-pressure port 301, and the pressure in the second cavity 4 is higher than the pressure in the first cavity 3, so that the driven valve core 2 returns to the third position from the fourth position and the high-pressure slurry in the second cavity 4 flows out of the second low-pressure port 401 to complete the pressure release process.

It may be understood that a structure of the driving valve core 1 in the example may adopt a structure of a brushless motor, a screw mechanism and a valve core combination as described in the patent document CN110130830A.

It may be understood that during mounting of the driving valve core 1 and the driven valve core 2 in the example, the driving valve core 1 and the driven valve core 2 may be sequentially mounted in a drilling tool body, or the driving valve core 1 and the driven valve core 2 may be mounted in one shell and the shell is integrally mounted in the drilling tool body.

It may be understood that the formation of the high-pressure slurry and the low-pressure slurry is the common knowledge of those skilled in the art, that is, the high-pressure slurry is slurry flowing into a hole at the center of the drilling tool, and the low-pressure slurry is slurry at the periphery of the drilling tool.

It may be understood that to limit the movement of the driven valve core 2, the first limiting portion and the second limiting portion are arranged on two sides of the driven valve core 2 so as to limit the driven valve core 2 to only move between the first limiting portion and the second limiting portion, and the limiting portions may be of structures such as a clamping groove or a protruded block and the like.

It may be understood that structures of the driving valve core 1 and the driven valve core 2 in the example are not limited to the structures shown in the figures, and may be adjusted in the actual work according to those skilled in the art.

EXAMPLE 2

Figure 4:
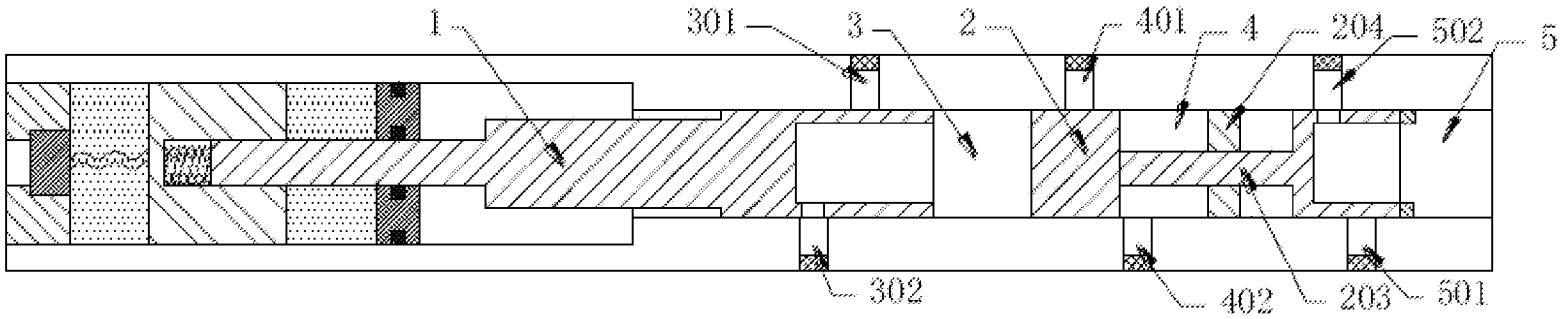
FIG. 4 is a structural schematic diagram of an another executing mechanism according to the present application.
Figure 5:
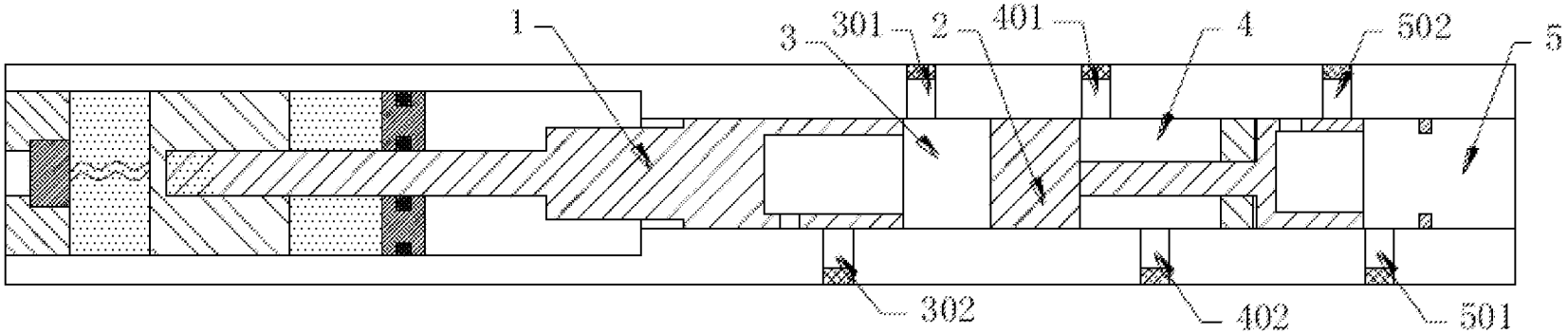
FIG. 5 is a schematic structural diagram of the executing mechanism in FIG. 4 in a working state.

In the example, an executing mechanism for a rotary guide device, as shown in FIG. 4 and FIG. 5, includes a driving valve core 1, a driven valve core 2, a first cavity 3, a second cavity 4 and a high-pressure slurry driving channel 5, wherein the driving valve core 1 is connected to the driven valve core 2 through the first cavity 3; two sides of the driven valve core 2 are respectively adjacent to the first cavity 3 and the second cavity 4; the first cavity 3 includes a first low-pressure port 301 communicating with low-pressure slurry, and the first cavity 3 further includes a first high-pressure port 302 communicating with high-pressure slurry; the second cavity 4 includes a second low-pressure port 401 communicating with the low-pressure slurry, and the second cavity 4 further includes a second high-pressure port 402 communicating with the high-pressure slurry; and the high-pressure slurry driving channel 5 includes a third high-pressure port 501 communicating with the high-pressure slurry, and the high-pressure slurry driving channel 5 further includes a third low-pressure port 502 communicating with the low-pressure slurry.

During use, when the executing mechanism in the example is in an initial state, as shown in FIG. 4, when the driving valve core 1 is at the first position, the first high-pressure port 302 opens and the first low-pressure port 301 closes at this time and the high-pressure slurry flows into the first cavity 3 from the first high-pressure port 302; when the driven valve core 2 is at the third position, the second high-pressure port 402 opens and the second low-pressure port 401 closes at this time and the high-pressure slurry flows into the second cavity 4 from the second high-pressure port 402; since there is no pressure difference between the first cavity 3 and the second cavity 4, the driven valve core 2 is in a stable state; when it is necessary to output the high-pressure slurry by the executing mechanism, as shown in FIG. 5, the driving valve core 1 moves from the first position to the second position, the first high-pressure port 302 closes and the first low-pressure port 301 opens at this time, and the pressure in the first cavity 3 decreases; since there is high pressure in the second cavity 4, the driven valve core 2 moves from the third position to the fourth position, the second high-pressure port 402 closes and the second low-pressure port 401 opens at this time; meanwhile, when the driven valve core 2 moves to the fourth position, the third high-pressure port 501 opens and the high-pressure slurry enters the high-pressure slurry driving channel 5 to perform high pressure output. After the output action ends, the driving valve core 1 returns to the first position from the second position and the first high-pressure port 302 opens, so that the driven valve core 2 returns to the third position from the fourth position, the third low-pressure port 502 opens, and the high-pressure slurry in the high-pressure slurry driving channel 5 flows out of the third low-pressure port 502 to release pressure.

It may be understood that the driven valve core 2 in the example includes a first valve core 201 and a second valve core 202; the first valve core 201 is connected to the second valve core 202 through a sliding rod 203; a blocking portion 204 is arranged between the first valve core 201 and the second valve core 202; and the sliding rod 203 slides in a hole at the center of blocking portion 204.

It may be understood that structures of the driving valve core 1 and the driven valve core 2 in the example are not limited to the structures shown in the figures, and may be adjusted in the actual work according to those skilled in the art.

EXAMPLE 3

An executing mechanism for a rotary guide device in the example further describes structures of the driving valve core 1 and the driven valve core 2 on the basis of the example 1. As shown in FIG. 2 and FIG. 3, the driving valve core includes a driving piece 101 and a valve core shaft 102, wherein one end of the valve core shaft 102 is connected to the driving piece 101 and the other end of the valve core shaft 102 is adjacent to the first cavity 3, a first connecting hole 1021 and a second connecting hole 1022 are respectively formed at one end, proximal to the first cavity 3, of the valve core shaft 102, the first cavity 3 communicates with the first low-pressure port 301 through the first connecting hole 1021, and the first cavity 3 communicates with the first high-pressure port 302 through the second connecting hole 1022; and the driving piece 101 is an electromagnetic valve 1011, and the valve core shaft 102 is connected to the electromagnetic valve 1011 through a spring 103. A blind hole 211 is formed at one end, distal from the first cavity 3, of the driven valve core 2, and an opening 212 communicating with the second high-pressure port 402 is formed in a side wall, at the blind hole 211, of the driven valve core 2.

The electromagnetic valve 1011 in the example is configured to drive the valve core shaft 102 to do reciprocating motion. When the electromagnetic valve 1011 is not powered on, the valve core shaft 102 is at a first position, as shown in FIG. 2; after the electromagnetic valve 1011 is powered on, the driven valve core 102 is stressed to arrive at a second position, as shown in FIG. 3; and after the electromagnetic valve 1011 is powered off, due to the spring 103, the valve core shaft 102 self-returns to the first position from the second position.

It may be understood that the driving piece 101 in the example may be a reciprocating mechanism and may also be a rotary disk valve structure; correspondingly, the driving piece may be implemented through driving of the electromagnetic valve 1011 and may also be implemented through driving of a motor, for example, motor direct driving or motor and ball screw driving; and the corresponding driver may be a driver of the electromagnetic valve 1011 and may also be a driver of the motor.

EXAMPLE 4

An executing mechanism for a rotary guide device in the example further describes the structure of the executing mechanism on the basis of the example 1. As shown in FIG. 2 and FIG. 3, the executing mechanism in the example further includes an outer shell 6, the driving valve core 1 and the driven valve core 2 are arranged in the outer shell 6 along an axial direction, the driving valve core 1 is connected to the driven valve core 2, a side wall of the outer shell 6 is respectively provided with a first low-pressure port 301 and a first high-pressure port 302 at the driving valve core 1, and a side wall of the outer shell 6 is respectively provided with a second low-pressure port 401 and a second high-pressure port 402 at the driven valve core 2. An inner wall of the outer shell 6 is provided with a first clamping groove 601 and a second clamping groove 602, the first clamping groove 601 is formed at one end, proximal to the first cavity 3, of the driven valve core 2, the second clamping groove 602 is formed at one end, proximal to the second cavity 4, of the driven valve core 2, and the driven valve core 2 moves between the first clamping groove 601 and the second clamping groove 602.

A sealing piece 7 and a balancing plunger piston 8 are arranged in the outer shell 6, the sealing piece 7 is arranged at one end, distal from the valve core shaft 102, of the driving piece 101, and a first oil immersing space 603 is formed between the sealing piece 7 and the driving piece 101; and the balancing plunger piston 8 is arranged at one end, distal from the sealing piece 7, of the driving piece 101, the balancing plunger piston 8 is arranged at the periphery of the valve core shaft 102 in a radial direction, and a second oil immersing space 604 is formed between the driving piece 101 and the balancing plunger piston 8.

It may be understood that filtering nets 9 are arranged at communication positions of the first low-pressure port 301, the first high-pressure port 302, the second low-pressure port 401 and the second high-pressure port 402 as well as the outside.

It may be understood that the first clamping groove 601 and the second clamping groove 602 may be formed in an manner that an inner wall of the outer shell 6 is sunken towards the periphery, and may also be formed by a connecting piece connected to the outer shell 6, wherein a specific structure is that the connecting piece extends into the inner wall of the outer shell 6 from an open end of the outer shell 6 and is connected to the inner wall of the outer shell 6, and one end, extending into the outer shell 6, of the connecting piece and the inner wall of the outer shell 6 form the second clamping groove 602.

It may be understood that the sealing piece 7 in the example is of a structure of a high-pressure sealing plug base and a high-pressure sealing plug; and the high-pressure sealing plug realizes electrical sealing and isolation, may be a two-core or multi-core sealing plug and can bear high pressure.

It may be understood that the balancing plunger piston 8 in the example includes a main body 801 and a plunger piston sealing piece 802, wherein the plunger piston sealing piece 802 is arranged between the main body 801 and the outer shell 6 and is arranged between the main body 801 and the valve core shaft 102; and the plunger piston sealing piece 802 is configured to realize sealing of the main body 801, may be an O-shaped ring and may also be other types of sealing rings.

EXAMPLE 5

Figure 6:
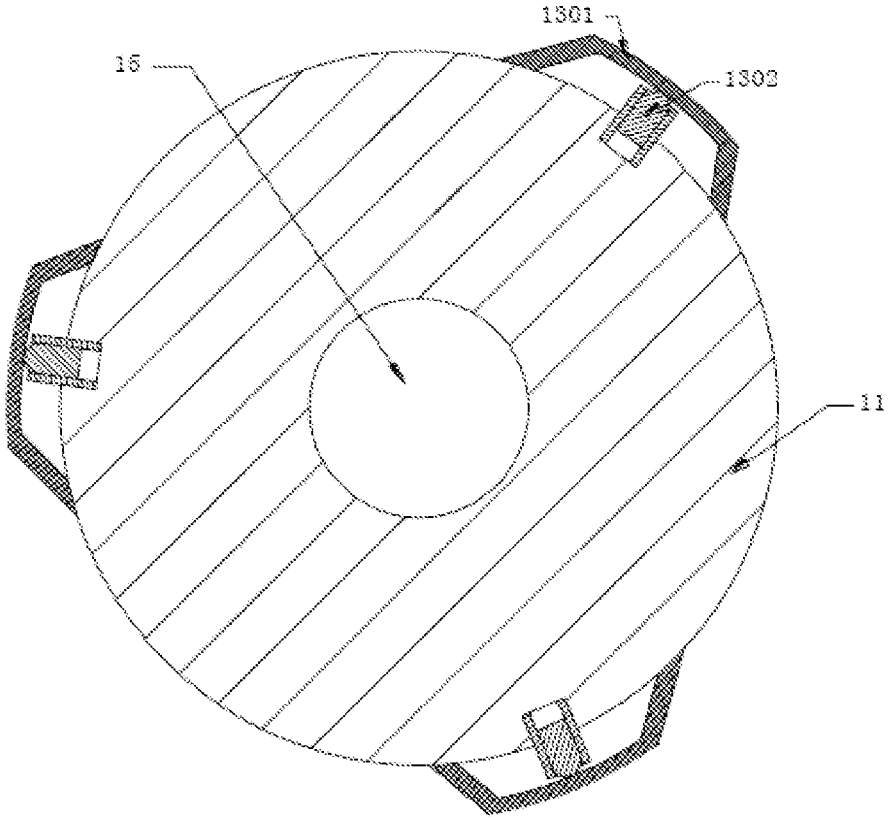
FIG. 6 is a structural schematic diagram of a push mechanism according to the present application.

The example discloses a rotary guide device, as shown in FIG. 1 and FIG. 6, including a rotary main shaft 11, a drill bit 12, a push mechanism 13 and an executing mechanism 14, wherein a slurry channel 15 is formed at the center of the rotary main shaft 11 along an axial direction; the drill bit 12 is connected to one end of the rotary main shaft 11; the push mechanism 13 is arranged at one end, proximal to the drill bit 12, of the rotary main shaft 11, as shown in FIG. 6, the push mechanism 13 includes a push block 1301 and a push plunger piston 1302 which are matched mutually, and the push block 1301 is arranged at the periphery of the push plunger piston 1302; and the executing mechanism 14 is arranged on the rotary main shaft 11, and the high-pressure slurry driving channel 5 in the executing mechanism 14 communicates with one end, distal from the push block 1301, of the push plunger piston 1302. In the example, the push mechanism 13 is driven by slurry power; a pressure of low-pressure slurry at the periphery of the rotary main shaft 11 is less than a pressure of high-pressure slurry in the slurry channel 15; the executing mechanism 14 is placed in the rotary main shaft 11; the periphery of the rotary main shaft 11 is respectively provided with a first low-pressure opening matched with the first low-pressure port 301 and is further provided with a second low-pressure opening matched with the second low-pressure port 401; the slurry channel 15 of the rotary main shaft 11 is provided with a first high-pressure port matched with the first high-pressure port 302 and is further provided with a second high-pressure opening matched with the second high-pressure port 402; when it is necessary to guide, the working process of the executing mechanism 14 takes the working process of the executing mechanism 14 in the example 1 as an example; during guidance, the high-pressure slurry enters the high-pressure slurry driving channel 5 and acts on the push plunger piston 1302 so as to act on the push block 1301 and complete the guide process; and after guidance and the executing mechanism 14 releases pressure, the full retraction of the push plunger piston 1302 mainly depends on a counter-acting force of the push block 1301 and a well wall, and redundant slurry between the driven valve core 2 and the push plunger piston 1302 is discharged from the second low-pressure port 401.

It may be understood that the full retraction of the push plunger piston 1302 mainly depends on the counter-acting force of the push block 1301 and the well wall. The executing mechanism 14 in the example has an overload protection function during work, that is, when the external vibration or impact environment is harsh, a pressure in the executing mechanism 14 is increased, the driving valve core 1 moves leftwards and compresses the spring 103 at this time, the redundant slurry is discharged from the second low-pressure port 401, and the safety protection function is completed, thereby improving the reliability of the system.

It may be understood that the rotary main shaft 11 is provided with three push mechanisms 13 uniformly along a circumferential direction, each push mechanism 13 is provided with an executing mechanism 14 in a matched way, and a groove structure for placing the executing mechanism 14 is arranged on the rotary main shaft 11.

EXAMPLE 6

In the example, on the basis of the example 5, as shown in FIG. 1, a flow adjusting piece 16 is arranged in the rotary guide device, the flow adjusting piece 16 is arranged at one end, proximal to the drill bit 12, of the slurry channel 15, and a throttling hole 1601 is formed at the center of the flow adjusting piece 16 along the axial direction.

The flow adjusting piece 16 adjusts the flow near the drill bit 12 so as to adjust a difference of pressure inside and outside the drill bit, various throttling ports with different water hole sizes may be arranged in the flow adjusting piece 16, and the difference of pressure inside and outside an instrument may be adjusted, so that an output force of the push plunger piston 1302 is adjusted.

EXAMPLE 7

Figure 7:
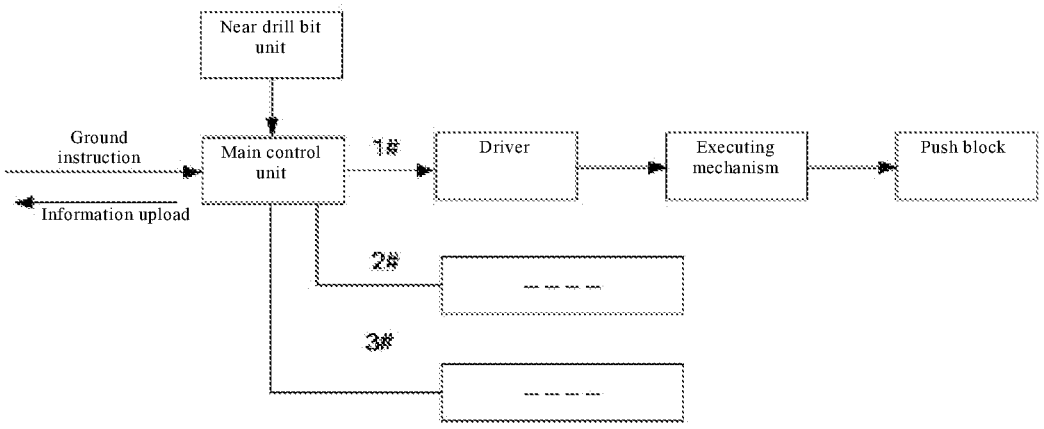
FIG. 7 is a schematic diagram of a control system of a rotary guide device according to the present application.

The example discloses a control system of a rotary guide device, as shown in FIG. 7, including a main control unit 17, a driver 18 and a near drill bit unit 19, wherein the near drill bit unit 19 is connected to the main control unit 17; the main control unit 17 is connected to the executing mechanism 14 through the driver 18; and the near drill bit unit 19 includes a dynamic measurement sensor, may measure information, such as well deviation, azimuth, a tool face, gamma and the like, of the near drill bit, cooperates with the main control unit 17 and the driver 18 to realize closed ring control and has a geological steering function. The main control unit 17 transmits a ground instruction to the driver 18 and uploads the received underground information.

The ground instruction is generally a control instruction of the tool face, specifically an instruction of a direction and build-up rate of a guide force. After the main control unit 17 receives the ground guide control instruction, information of the near drill bit unit 19 is acquired firstly and the position of the push block 1301 is monitored constantly. When one of the push blocks 1301 is located within the range of the expected guide force, the driver 18 and the executing mechanism 14 start to act and the primary action force is output. Theoretically speaking, the tertiary action force may be output at most when the main shaft turns one revolution, but considering the limitation of the expected build-up rate, it is possible that three plunger pistons only output primary or secondary action force when the main shaft turns one revolution, which is similar to the PWM modulation method in electrical control. The specific output ratio should be determined according to the actual operation requirements.

Each example in the specification is described in a progressive manner. The same and similar parts among the examples are referenced to each other. Each example focuses on the differences from other examples. In particular, for the system example which is basically similar to the method example, the description is relatively simple, and the relevant points are referenced to the partial description of the method example.

The above is only an example of the present application and is not intended to limit the present application. For those skilled in the art, the application may have various modifications and changes. Any modifications, equivalent substitutions, improvements, etc. made within the spirit and principle of the present application should be included within the scope of the claims of the present application.

What is claimed is:

1. An executing mechanism for a rotary guide device, including: a driving valve core, a driven valve core, a first cavity, a second cavity and a high-pressure slurry driving channel, wherein the first cavity comprises a first low-pressure port communicating with low-pressure slurry, the first cavity further comprises a first high-pressure port communicating with high-pressure slurry, the driving valve core moves to open and close the first low-pressure port and the high-pressure port to adjust a pressure in the first cavity, two sides of the driven valve core are respectively adjacent to the first cavity and the second cavity, the driven valve moves in response to a pressure difference between the first cavity and the second cavity, the driven valve core is connected to the high-pressure slurry driving channel, and the high-pressure slurry driving channel switches between an open state and a close state in response to movement of the driven valve core.

2. The executing mechanism according to claim 1, wherein the second cavity comprises a second low-pressure port communicating with low-pressure slurry, and the second cavity further comprises a second high-pressure port communicating with high- pressure slurry;

the driving valve core moves between a first position and a second position, the first low- pressure port opens and the first high-pressure port closes when the driving valve core is at the first position, and the first low-pressure port closes and the first high-pressure port opens when the driving valve core is at the second position;

the driven valve core moves between a third position and a fourth position, the second low-pressure port opens and the second high-pressure port closes when the driven valve core is at the third position, and the second low-pressure port closes and the second high-pressure port opens when the driven valve core is at the fourth position; and the driven valve core moves in response to the driving valve core when the driving valve moves from the first position to the second position, and the high-pressure slurry driving channel communicates with the second cavity when the driven valve core moves from the third position to the fourth position.

3. The executing mechanism according to claim 2, further comprising an outer shell, wherein the driving valve core and the driven valve core are arranged in the outer shell along an axial direction, the driving valve core is connected to the driven valve core through the first cavity, a side wall of the outer shell is respectively provided with a first low-pressure port and a first high-pressure port at a position of the driving valve core, and the side wall of the outer shell is respectively provided with a second low-pressure port and a second high-pressure port at a position of the driven valve core.

4. The executing mechanism according to claim 3, wherein an inner wall of the outer shell is provided with a first clamping groove and a second clamping groove, the first clamping groove is formed in one side, proximal to the first cavity, of the driven valve core, the second clamping groove is formed in one side, proximal to the second cavity, of the driven valve core, and the driven valve core moves between the first clamping groove and the second clamping groove.

5. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 4, the executing mechanism being arranged on the rotary main shaft, and the high-pressure slurry driving channel in the executing mechanism communicating with one end, distal from the push block, of the push plunger piston.

6. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 3, the executing mechanism being arranged on the rotary main shaft, and the high-pressure slurry driving channel in the executing mechanism communicating with one end, distal from the push block, of the push plunger piston.

7. The executing mechanism according to claim 2, wherein a blind hole is formed at one end, distal from the first cavity, of the driven valve core, and an opening configured to communicate with the second high-pressure port is formed in a side wall, at the position of the blind hole, of the driven valve core.

8. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 7, the executing mechanism being arranged on the rotary main shaft, and the high-pressure slurry driving channel in the executing mechanism communicating with one end, distal from the push block, of the push plunger piston.

9. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 2, the executing mechanism being arranged on the rotary main shaft, and the high-pressure slurry driving channel in the executing mechanism communicating with one end, distal from the push block, of the push plunger piston.

10. The rotary guide device according to claim 9, further comprising a flow adjusting piece, wherein the flow adjusting piece is arranged at one end, proximal to the drill bit, in the slurry channel, and a throttling hole is axially formed at the center of the flow adjusting piece.

11. The executing mechanism according to claim 1, further comprising a first limiting portion and a second limiting portion, the driven valve core moves between the first limiting portion and the second limiting portion, the first limiting portion is arranged between the first cavity and the driven valve core, and the second limiting portion is arranged between the second cavity and the driven valve core.

12. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 11, the executing mechanism being arranged on the rotary main shaft, and the high-pressure slurry driving channel in the executing mechanism communicating with one end, distal from the push block, of the push plunger piston.

13. The rotary guide device according to claim 12, further comprising a flow adjusting piece, wherein the flow adjusting piece is arranged at one end, proximal to the drill bit, in the slurry channel, and a throttling hole is axially formed at the center of the flow adjusting piece.

14. The executing mechanism according to claim 1, wherein the driving valve core comprises a driving piece and a valve core shaft, one end of the valve core shaft is connected to the driving piece and the other end of the valve core shaft is adjacent to the first cavity, a first connecting hole and a second connecting hole are respectively formed at one end, proximal to the first cavity , of the valve core shaft, the first cavity communicates with the first low-pressure port through the first connecting hole, the first cavity communicates with the first high-pressure port through the second connecting hole, the driving piece is an electromagnetic valve, and the valve core shaft is connected to the electromagnetic valve through a spring.

15. The executing mechanism according to claim 14, further comprising a sealing piece and a balancing plunger piston, wherein the sealing piece is arranged at one end, distal from the valve core shaft, of the driving piece, and a first oil immersing space is formed between the sealing piece and the driving piece; and the balancing plunger piston is arranged at one end, distal from the sealing piece, of the driving piece, the balancing plunger piston is arranged at the periphery of the valve core shaft in a radial direction, and a second oil immersing space is formed between the driving piece and the balancing plunger piston.

16. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 15, the executing mechanism being arranged on the rotary main shaft, and the high-pressure slurry driving channel in the executing mechanism communicating with one end, distal from the push block, of the push plunger piston.

17. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 14, the executing mechanism being arranged on the rotary main shaft, and the high-pressure slurry driving channel in the executing mechanism communicating with one end, distal from the push block, of the push plunger piston.

18. The rotary guide device according to claim 17, further comprising a flow adjusting piece, wherein the flow adjusting piece is arranged at one end, proximal to the drill bit, in the slurry channel, and a throttling hole is axially formed at the center of the flow adjusting piece.

19. A rotary guide device, comprising a rotary main shaft, a slurry channel being formed at a center of the rotary main shaft along an axial direction;

a drill bit, the drill bit being connected to one end of the rotary main shaft;

a push mechanism, the push mechanism being arranged at one end, proximal to the drill bit, of the rotary main shaft, the push mechanism including a push block and a push plunger piston, the push plunger piston fits in a groove or opening of the push block, and the push block being arranged at the periphery of the push plunger piston; and the executing mechanism according to claim 1, the executing mechanism being arranged on the rotary main shaft, and the high-pressure slurry driving channel in the executing mechanism communicating with one end, distal from the push block, of the push plunger piston.

20. The rotary guide device according to claim 19, further comprising a flow adjusting piece, wherein the flow adjusting piece is arranged at one end, proximal to the drill bit, in the slurry channel, and a throttling hole is axially formed at the center of the flow adjusting piece.

* * * * *